United States Patent [19]

Hertell

[11] 4,164,384

[45] Aug. 14, 1979

[54] ROTARY VANE VACUUM PUMP WITH FILTER MEANS FOR INLET

[75] Inventor: Siegfried Hertell, Radevormwald, Fed. Rep. of Germany

[73] Assignee: Barmag Barmer Maschinenfabrik AG, Remscheid-Lennep, Fed. Rep. of Germany

[21] Appl. No.: 806,191

[22] Filed: Jun. 13, 1977

[30] Foreign Application Priority Data

| | | |
|---|---|---|
| Jun. 15, 1976 | [DE] | Fed. Rep. of Germany ... 7618891[U] |
| Jun. 30, 1976 | [DE] | Fed. Rep. of Germany ..... 2629337 |
| Mar. 22, 1977 | [DE] | Fed. Rep. of Germany ..... 2712480 |

[51] Int. Cl.[2] ..... F04C 29/02; B01D 27/00; B01D 35/00; B01D 50/00

[52] U.S. Cl. ..... 418/47; 418/97; 55/467; 55/482; 55/525

[58] Field of Search ..... 418/46, 47, 96–100; 55/467, 482, 525, 529

[56] References Cited

U.S. PATENT DOCUMENTS

| | | | |
|---|---|---|---|
| 1,769,153 | 7/1930 | Meyer | 418/47 |
| 1,879,136 | 9/1932 | Dubrovin | 418/98 |
| 2,685,776 | 8/1954 | Oishei et al. | 418/47 |
| 3,525,578 | 8/1970 | Le Blanc | 418/96 |
| 3,711,228 | 1/1973 | Foley | 418/98 |

FOREIGN PATENT DOCUMENTS

| | | | |
|---|---|---|---|
| 620465 | 10/1935 | Fed. Rep. of Germany | 418/96 |

OTHER PUBLICATIONS

*Mechanical Pumps, Fittings, and Accessories,* Dresser Vacuum Catalogue No. 200–1, 1963, p. 4.

*Primary Examiner*—John J. Vrablik
*Attorney, Agent, or Firm*—John H. Shurtleff

[57] ABSTRACT

An improved design of a rotary vane-type vacuum pump which prevents the oil used to lubricate the moving parts of the pump from entering the intake line of a connected vacuum chamber. The improvement comprises forming the inlet port in the front face of the cover plate which seals the end of the rotor casing. Filters are positioned in the intake port to catch any oil flowing along the inner wall of the intake port and to condense any oil foam entering therein. In order to facilitate the condensing of the oil foam, the inlet port is divided into two connected chambers, the lower of said chambers being of sufficient capacity to collect said oil foam flowing from the pump during its operation. A check valve is also positioned in the inlet port ahead of said filters in order to prevent the vacuum pressure in the vacuum chamber and intake line from dissipating through the pump and oil mist being drawn into the intake port when the pump is stopped.

7 Claims, 4 Drawing Figures

ROTARY VANE VACUUM PUMP WITH FILTER MEANS FOR INLET

INTRODUCTION

The present invention relates generally to a rotary vane-type vacuum pump and, more particularly, to an improved design thereof which prevents the oil used to lubricate the moving parts of the pump from entering the intake line of a connected vacuum chamber.

BACKGROUND OF THE INVENTION

In older vane-type vacuum pumps, the rotor and vanes were generally made of steel. However, since such construction resulted in the rotor and vanes being relatively heavy, strong centrifugal forces were created during the operation of the pump which shortened the service life of the device. For this reason, manufacturers have more recently begun making the rotors of sintered metals. Such rotors are advantageous for both production and cost reasons. Furthermore, such rotors are very strong while being both light weight and wear resistant.

However, since oil is used to lubricate the moving parts of the pump, the introduction of sintered metal as the rotor material has resulted a disadvantage that substantially more oil can be absorbed in its pores than with steel. Therefore, at high rotational speeds, substantially more oil will be spun out of the rotor pores and be deposited against the walls of the rotor casing.

Since production techniques have usually required that the inlet opening of the pump extend radially outward through the casing, the separated oil would be thrown into this suction inlet opening. This oil would be deposited on the walls of the inlet opening and creep along them toward the vacuum chamber in spite of the opposed suction effect. Such oil flow has been found to be especially damaging to vacuum systems such as brake energizers since such systems generally have a diaphragm wall which is susceptable to being attacked by the oil, thereby rendering the entire brake energizer system inoperable.

BRIEF DESCRIPTION OF THE INVENTION

The present invention generally avoids the above-discussed problems by allowing the rotor of a vane-type vacuum pump to be made of a sintered material without any danger that oil will be permitted to flow into the intake line of a connected vacuum chamber such as a brake energizer.

The present invention advantageously accomplishes this result by forming the inlet port in the front face of the cover plate which seals the rotor casing at its axial end. As a result of this design, oil can no longer be directly thrown into the inlet port.

Furthermore, in order to prevent the vacuum pressure in the vacuum chamber and intake line from dissipating through the pump and oil mist being drawn into the intake port if the pump suddenly stops, a check valve may be positioned in the inlet port. This particular embodiment of the present invention offers the further advantage of permitting the brake energizer of a motor vehicle to become fully functional as soon as the engine is started again after it has been briefly stopped in that the pump is not again required to evacuate the vacuum chamber.

Even if it is not necessary that the vacuum pressure be maintained after the pump is turned off, it is important that any resulting reverse air current not deliver oil to the intake line or vacuum chamber. Hence, another embodiment of the present invention proposes placing a filter in the inlet port to prevent this occurrence.

If oil foam also appears in the system, a filter which acts as a condensation plate may be placed at the point connecting two chambers of the inlet port which have differing capacities in order to separate the oil from the oil foam. For this reason, it is advantageous to construct both the filter and the chamber below it out of metal.

Since it is not possible for such a filter element to hold back any oil flowing along the walls of the inlet port, a further embodiment of the present invention provides for a second, cup-shaped suspension mounted filter to be positioned, in an intake direction, in the chamber ahead of the other connected chamber. In order to facilitate the dripping of oil off of this filter, it is preferably that its drip nose contacts the first filter.

In order to ensure a safe transporting of a bigger quantity of oil, it is suggested that the drip nose is centrically penetrating the first filter. By doing so, the course of the drop is no longer interrupted.

In order that for this arrangement the oil drops can be forwarded in a better way, the second filter is arranged non-porously within the range of the drip nose, which is equipped with a bore inside. Thus, an enlarged suction force is acting onto the drops on the inner wall of the filter. Furtheron it is avoided that—when stopping the pump—, oil is remaining within the filter and is creeping along the inner wall of the inlet port in direction to the vacuum chamber.

In order to facilitate the erection of the filters in the inlet port, it is recommended to arrange said filters in a bushing. The completely pre-erected bushing then will be installed into the inlet port. Moreover, it is advantageous that both, bushing and second filter are forming one unit and should be manufactured of plastic material, because the second filter is acting as a barrier for the oil, which is creeping along the inner wall of the inlet port. It is recommended to use a non-wetting plastic material.

Locating the check valve ahead, in an intake direction, of said second filter ensures in a simple manner that oil cannot enter the vacuum chamber and that the vacuum pressure in the chamber will not dissipate if there is an interruption in the operation of the vacuum pump. With the present invention it is possible to use very simply constructed check valves whose sealing effect is based only upon the elasticity of a rubber ring which opens or closes the openings in an orifice plate in response to the vacuum pressure. The use of such simple check valves in the inlet port have not been possible before the present invention due to the fact that oil deposited on the rubber ring caused it to stick to the orifice plate thereby not allowing it to open either when the the pump was operated or when there was a vacuum present on the pump inlet side of the system.

DESCRIPTION OF THE PREFERRED EMBODIMENT

Figure 1:
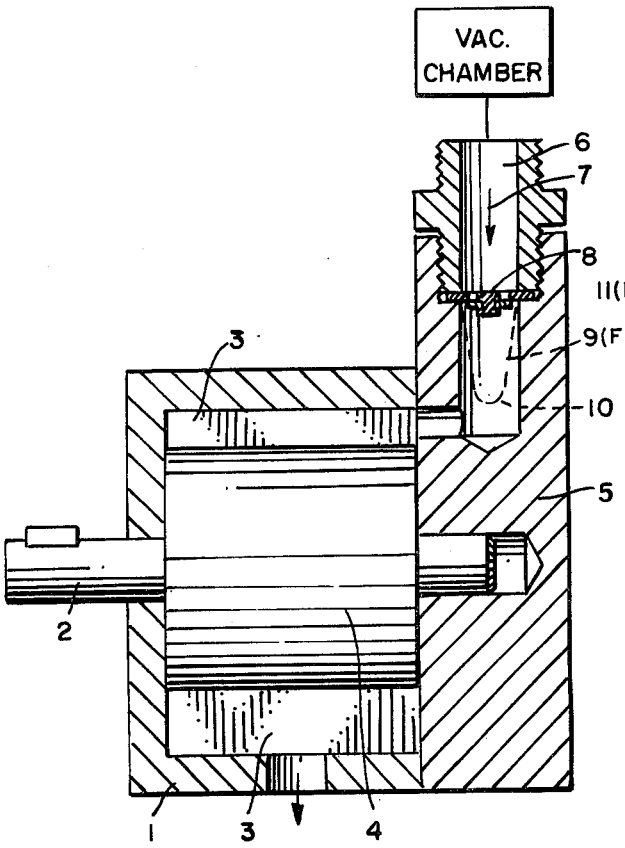
FIG. 1 is a side cross-sectional view of a rotary vane-type vacuum pump constructed in accordance with an embodiment of the present invention with the rotor cross-sectional portion being taken along lines I—I of FIG. 2.
Figure 2:
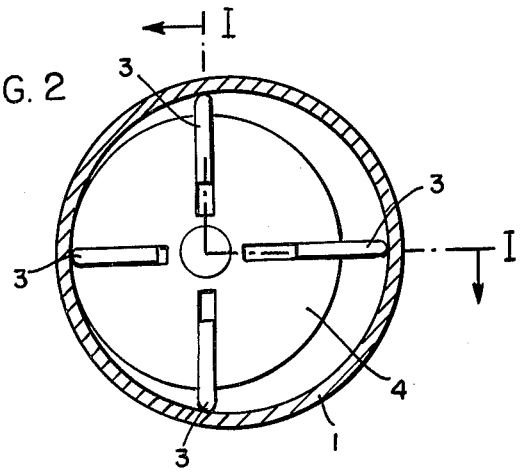
FIG. 2 is an end cross-sectional view of a portion of the apparatus shown in FIG. 1.

FIGS. 1 and 2 illustrate an embodiment of a rotary vane-type vacuum pump constructed in accordance with the present invention. In general, the pump consists of a rotor casing 1, drive shaft 2, a plurality of vanes 3 which are axially fulcrummed at rotor 4, and an end cover plate 5.

In operation, the pump evacuates a vacuum chamber, such as a brake energizer, through inlet port 6 which is formed in the front face of cover plate 5. The pump outlet port which is preferably displaced by approximately 180 degress from the inlet port may also be located in cover plate 5 as is illustrated in phantom lines in the embodiment shown in FIG. 3 or it may lead radially outward from casing 1. A check valve 8 is mounted in the intake port 6 ahead of filter 9 in intake direction 7.

As oil creeps upward along the walls of inlet port 6 during operation of the pump, it is stripped off the inner wall of the inlet port at filter 9. Due to gravity and suction effects, the oil will flow along the outer surface of the filter to its drip nose 10. When the oil drop becomes sufficiently large, it will be drawn away from this point by the suction action of the pump. Due to the fact that check valve 8 is not moistened by the oil, it will not lose its operability during the life of the pump.

Figure 3:
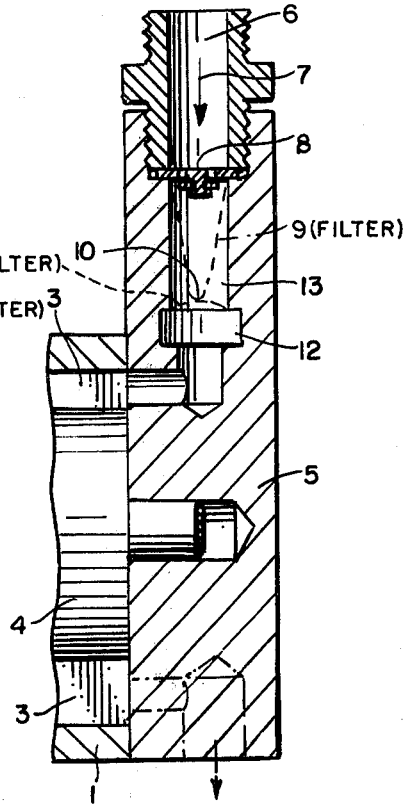
FIG. 3 is a partial side cross-sectional view of a rotary vane-type pump constructed in accordance with an alternate embodiment of the present invention.

The pump illustrated in FIG. 3 has an inlet port 6 of a differing arrangement. The inlet port is divided into two connected chambers 12 and 13 of differing capacities. Lower chamber 12 is separated from upper chamber 13 by filter 11 which has a cross-sectional area of substantially the same size as the cross-sectional area of the chambers. Filter 11 and chamber 12 have the function of catching the oil foam drawn from the pump casing and, hence, are preferably made of metal. The size of chamber 12 corresponds to the amount of oil foam expected to be drawn from the pump casing. The oil foam will condense on filter 11 and be channeled back into the pump.

Figure 4:
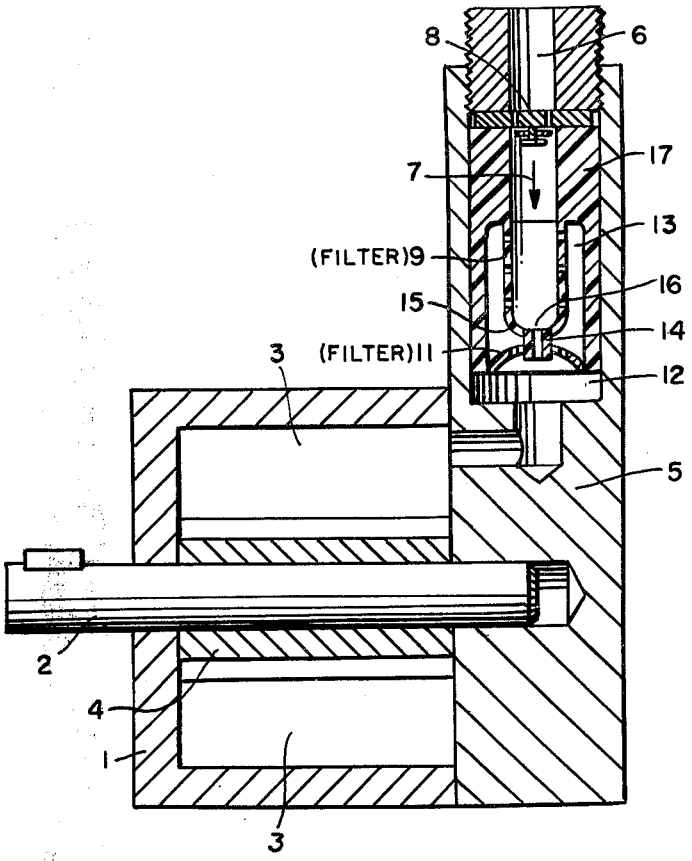
FIG. 4 is an alternate embodiment of the partial side cross-sectional view of the pump, shown in FIG. 3.

A second cup-shaped filter 9 is suspension mounted in chamber 13 ahead of filter 11 in intake direction 7. Filter 9 serves to divert any oil flowing out of chamber 12 along the inner wall of the inlet port away from check valve 8 so that it and the remainder of the intake line will remain free of oil. For this reason, both filter 9 and chamber 13 are preferably made of a non-wetting material such as plastic. The connection of filters 9 and 11 by drip nose 10 facilitates the dripping off of the oil collected by filter 9. FIG. 4 shows an alternate arrangement of the two filters 9 and 11 in the intake port 6. Here, the chamber 13 is limited by the plastic bushing 17, to which bushing the second filter 9 is mounted. The plastic bushing 17 is fitted in chamber 12, which has a greater diameter than the chamber 13.

The second filter 9 shows a cylindrical shape. At its lower part, seen in intake direction, the filter 9 shows a marked drip nose 14. Within the range of the drip nose 14, the filter 9 is layed out non porously, i.e. a small tank 15 is formed. The flow-off of this tank 15 is built by a centrical bore.

The drip nose penetrates the first filter 11, which filter is formed as a convex ball segment and is arranged in front of bushing 17. Because of the shape of the filter, also in this case the oil flows down at the filter. Based on the suction force of the pump, the oil is re-transported either through bore 16 or along the outer wall of the filter 9 via filter 11.

The pump as shown in FIG. 4 functions in the same way as shown in FIG. 1 respectively FIG. 3.

While several particular embodiments of the present invention have been shown and described in detail, it should be understood that various obvious changes and modifications thereto may be made, and it is therefore intended in the following claims to include all such modifications and changes as may fall within the spirit and scope of this invention.

What is claimed is:

1. In a rotary vane-type vacuum pump having a driven rotor element with vanes mounted thereon located within a casing which is sealed at one end by a cover plate, wherein the improvement comprises:
   - an inlet port formed in the front face of said cover plate which is divided into upper and lower connected chambers of differing capacities,
   - a first filter located at the connecting point between said chambers and extending across the cross-sectional area thereof,
   - a second cup-shaped filter suspension mounted in said upper chamber which is located, in an intake direction, ahead of said lower chamber, and
   - a check valve located in said upper chamber.

2. The vacuum pump of claim 1 wherein said second filter has a drip nose which contacts said first filter.

3. The vacuum pump of claim 2 wherein said drip nose is centrically penetrating the first filter via a bore.

4. The vacuum pump of claim 3 wherein in the area of said drip nose the second filter is layed out non-porously and shows an axially extended bore within said drip nose.

5. The vacuum pump of claim 4 wherein said two filters are arranged in a bushing, said bushing being adapted to the inlet port and forming said upper chamber which is located, in an intake direction, ahead of said lower chamber.

6. The vacuum pump of claim 5 wherein the second filter and said bushing form one unit and are manufactured of plastic material.

7. The vacuum pump of claim 6 wherein said check valve is located, in an intake direction, ahead of said second filter.

* * * * *